US010480364B2

(12) United States Patent
Wicks

(10) Patent No.: US 10,480,364 B2
(45) Date of Patent: Nov. 19, 2019

(54) VALVE SHIELD FOR AN INTERNAL COMBUSTION ENGINE

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 78 days.

(21) Appl. No.: 15/698,124

(22) Filed: Sep. 7, 2017

(65) Prior Publication Data

US 2019/0072013 A1 Mar. 7, 2019

(51) Int. Cl.

| | |
|---|---|
| ***F01M 1/06*** | (2006.01) |
| ***F01M 9/10*** | (2006.01) |
| ***F01L 3/08*** | (2006.01) |
| ***F01M 1/02*** | (2006.01) |

(52) U.S. Cl.

CPC ..... *F01M 9/103* (2013.01); *F01L 3/08* (2013.01); *F01M 1/02* (2013.01); *F01L 2810/02* (2013.01)

(58) Field of Classification Search

CPC ... F01M 9/103; F01M 1/02; F01L 3/08; F01L 2810/02

See application file for complete search history.

(56) References Cited

U.S. PATENT DOCUMENTS

| | | | | |
|---|---|---|---|---|
| 3,228,384 | A | 1/1966 | Brown | |
| 3,581,728 | A | 6/1971 | Abraham et al. | |
| 4,008,927 | A * | 2/1977 | Mayer | B23P 13/00 123/195 R |
| 4,125,265 | A | 11/1978 | Grzesiak | |
| 5,465,691 | A * | 11/1995 | Capaldo | F01L 3/08 123/188.9 |
| 6,837,201 | B1 * | 1/2005 | Cheng | F01M 9/106 123/188.1 |
| 2007/0175705 | A1 * | 8/2007 | Adolf | F01L 3/08 184/6.5 |
| 2016/0281550 | A1 | 9/2016 | Erdman et al. | |

* cited by examiner

*Primary Examiner* — Zelalem Eshete

(74) *Attorney, Agent, or Firm* — Brooks Kushman P.C.; Geoffrey Brumbaugh

(57) ABSTRACT

An engine is provided with a cylinder head defining a lubrication gallery intersecting a valve guide bore wall, and a valve guide. The valve guide has inner and outer walls intersecting valve-side and port-side ends. The inner wall defines a channel extending from an intermediate region of the guide to the valve-side end. The guide defines a passage extending outwardly from the channel at the intermediate region to the outer wall, with the passage fluidly connected to the gallery. Pressurized lubricant is provided to a lubrication gallery intersecting a valve guide bore wall of the cylinder head. Lubricant is directed from the gallery into a passage extending through an intermediate region of a valve guide. A moving valve stem positioned within the guide is lubricated by flowing lubricant from the passage into a channel intersecting the inner wall of the guide and to a valve end of the guide.

19 Claims, 4 Drawing Sheets

VALVE SHIELD FOR AN INTERNAL COMBUSTION ENGINE

TECHNICAL FIELD

Various embodiments relate to a valve shield and a valve in a cylinder head of an internal combustion engine.

BACKGROUND

Internal combustion engines, including four-stroke engines, use valves to control the flow of intake gases, e.g. air or a fuel-air mixture, from an intake manifold into the cylinder, and use valves to control the flow of exhaust gases from the cylinder to an exhaust manifold. Conventionally, the valves are provided as poppet valves, with each valve including a valve stem extending to a valve head. A valve guide is provided to positively locate the valve in relation to the valve seat, help in sealing the intake or exhaust manifold, and to provide thermal protection for the valve. The valve stem extends through and moves relative to a valve guide as a running surface, and the interface between the valve guide and the running surface of the valve stem is unlubricated in a conventional valve. With engine operation and time, the valve guide may experience wear, distortion, and reduced mechanical properties as the interface between the valve stem and the valve guide may result in friction and heat.

SUMMARY

In an embodiment, an engine is provided with a cylinder head defining a lubrication gallery intersecting a valve guide bore wall, and a valve guide. The valve guide has inner and outer walls intersecting valve-side and port-side ends. The inner wall defines a channel extending from an intermediate region of the guide to the valve-side end. The guide defines a passage extending outwardly from the channel at the intermediate region to the outer wall, with the passage fluidly connected to the gallery.

In another embodiment, an engine valve guide is provided by an annular cylindrical member having an inner wall and an outer wall intersecting a valve-side end and a port-side end. The inner wall defines a channel extending from the valve-side end to an intermediate region of the member. The intermediate region of the member defines a passage extending radially therethrough and intersecting the outer wall and the channel.

In yet another embodiment, a method is provided and includes providing pressurized lubricant to a lubrication gallery defined in a cylinder head, with the lubrication gallery intersecting a valve guide bore wall of the cylinder head. Lubricant is directed from the lubrication gallery into a passage extending through an intermediate region of a valve guide from an outer wall to an inner wall. A moving valve stem positioned within the valve guide is lubricated by flowing lubricant from the passage into an entrance of a channel intersecting the inner wall and to an exit of the channel at a valve end of the guide, with the channel following a curved path along the inner wall of the guide.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
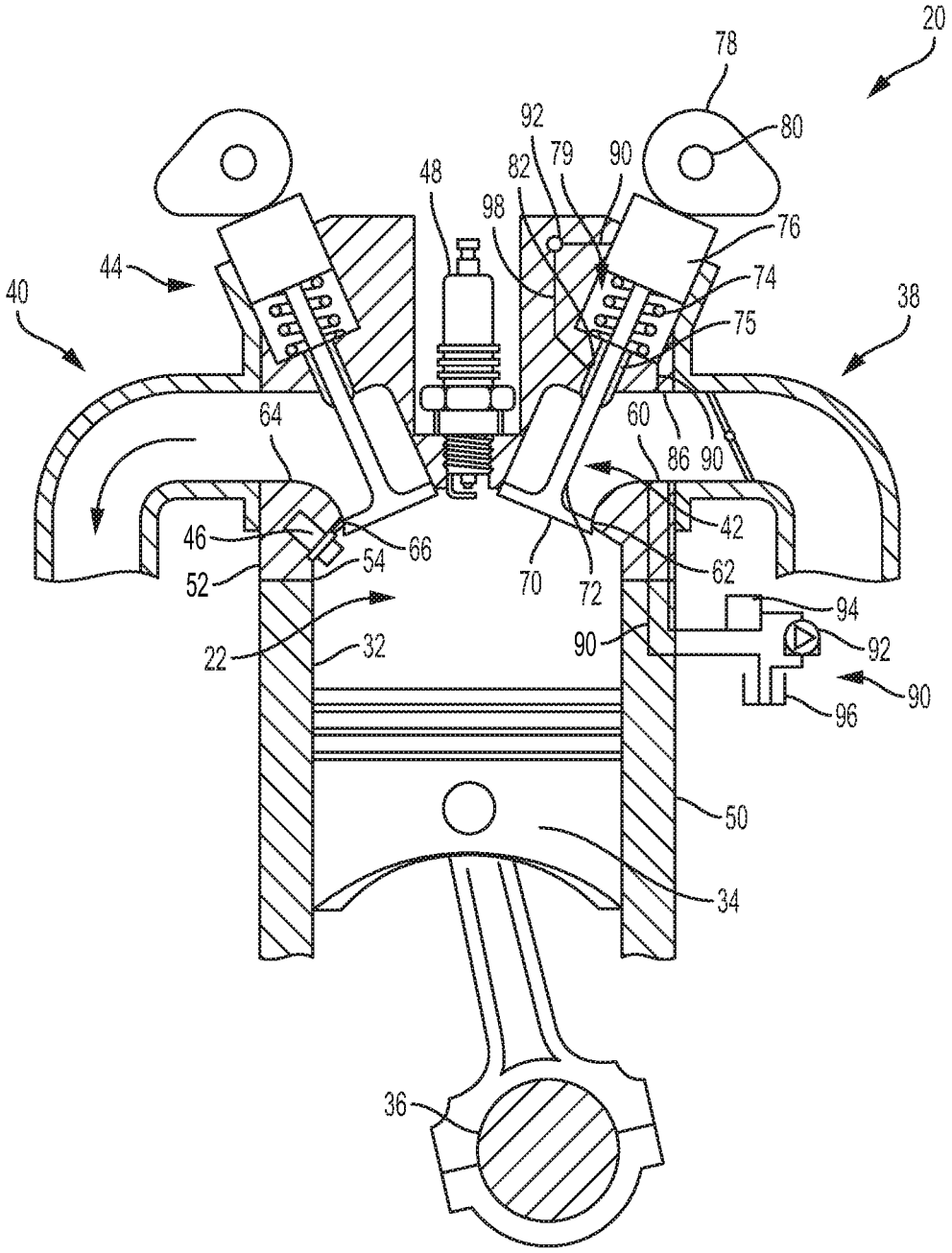
FIG. 1 illustrates a schematic of an internal combustion engine capable of implementing the disclosed embodiments.

FIG. 1 illustrates a schematic of an internal combustion engine 20. The engine 20 has a plurality of cylinders 22, and one cylinder is illustrated. The cylinder 22 is formed by cylinder walls 32 and piston 34, and is also referred to herein as a combustion chamber 22. The piston 34 is connected to a crankshaft 36. The combustion chamber 22 is in fluid communication with the intake manifold 38 and the exhaust manifold 40. One or more intake valves 42 controls flow from the intake manifold 38 into the combustion chamber. One or more exhaust valves 44 controls flow from the combustion chamber to the exhaust manifold 40. The intake and exhaust valves 42, 44 may be operated in various ways as is known in the art to control the engine operation. The operation of the intake valve 42 and exhaust valve 44 are described in greater detail below.

A fuel injector 46 delivers fuel from a fuel system directly into the combustion chamber 22 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber. The spark plug 48 may be located in various positions within the combustion chamber 22. In other embodiments, other fuel delivery systems and ignition systems or techniques may be used, including indirect injection or compression ignition.

The engine 20 includes a controller and various sensors configured to provide signals to the controller for use in controlling the air and fuel delivery to the engine, the ignition timing, valve timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two-stroke cycle. The piston 34 position at the top of the cylinder 22 is generally known as top dead center (TDC). The piston 34 position at the bottom of the cylinder is generally known as bottom dead center (BDC).

During the intake stroke, the intake valve(s) 42 opens and the exhaust valve(s) 44 closes while the piston 34 moves from the top of the cylinder 22 to the bottom of the cylinder 22 to introduce intake gases, e.g. air, from the intake manifold to the combustion chamber. Fuel may be introduced into the cylinder 22 while the piston 34 moves down during the intake stroke.

During the compression stroke, the intake and exhaust valves 42, 44 are closed. The piston 34 moves from the bottom towards the top of the cylinder 22 to compress the air/fuel mixture within the combustion chamber 22.

The compressed air/fuel mixture is then ignited within the combustion chamber 22. In the engine 20 shown, the fuel is injected into the chamber 22 and is then ignited using spark plug 48. In other examples, the fuel may be ignited using compression ignition or may be introduced into the intake gases prior to the cylinder, e.g. via indirect injection.

During the compression/expansion stroke, the ignited fuel-air mixture in the combustion chamber 22 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve(s) 42 remains closed, and the exhaust valve(s) 44 opens. The piston 34 moves from the bottom of the cylinder to the top of the cylinder 22 to remove the exhaust gases and combustion products from the combustion chamber 22 by reducing the volume of the chamber 22. The exhaust gases flow from the combustion cylinder 22 to the exhaust manifold 40 and to an aftertreatment system such as a catalytic converter.

The intake and exhaust valves 42, 44 positions and timing, as well as the fuel injection timing and ignition timing may be varied for the various engine strokes.

The engine 20 has an engine cylinder block 50 and a cylinder head 52. A head gasket 54 is interposed between the cylinder block 50 and the cylinder head 52 to seal the cylinders 22.

The cylinder head 52 defines an intake air port 60. The intake air port 60 provides a passage for flow of intake air or intake gases from the intake manifold 38 to a respective cylinder 22. Intake air may include outside or environmental air, may include fuel mixed therein, and may also be mixed with exhaust gases from an exhaust gas recirculation system, etc. The intake air port 60 has a seat 62. The seat 62 acts as an opening into the combustion chamber 22 that cooperates with the intake valve 42 to seal the port 60 or prevent flow of intake air into the chamber 22 when the intake valve 42 is "seated" against the seat 62.

The cylinder head 52 defines an exhaust gas port 64. The exhaust gas port 64 provides a passage for flow of exhaust gases from each cylinder 22 to the exhaust manifold 40. The exhaust gas port has a seat 66. The seat 66 acts as an opening into the combustion chamber 22 that cooperates with the exhaust valve 44 to seal the port 64 or prevent flow of exhaust gases into the port 64 when the exhaust valve 44 is "seated" against the seat 66.

The engine 20 is illustrated as having the intake valve 42 and the exhaust valve 44 as poppet type valves in a direct overhead cam configuration. The engine and intake and exhaust valves 42, 44 may be configured in various manners as is known in the art, for example, as a single overhead camshaft, dual overhead camshaft, direct camshaft actuation, an overhead valve configuration with the valves operated by pushrods or rockers, and the like. Each valve 42, 44 is shown as being mechanically operated by a respective camshaft; however, in other examples, the valves 42, 44 may be hydraulically or electrically controlled.

The intake valve 42 is described as follows; however, the exhaust valve 44 has the same or similar components such that the following description for the intake valve 42 may also be applied to the exhaust valve 44 in various embodiments. The valve 42 has a head 70 that is connected to an end of a valve stem 72. The head 70 may have various shapes, and is sized to mate with the seat 62 when the valve 42 is in a closed position. The head 70 extends radially outwardly from the stem 72.

The stem 72 is actuated by a valve mechanism. In the present example, the valve mechanism includes a spring 74 that biases the head 70 towards an open position with the head 70 unseated from the seat 62 to allow intake gases from the intake manifold through the intake port 60 and into the cylinder. The spring 74 is supported and located at one end by a spring seat 75.

The valve mechanism also includes a tappet 76. The tappet 76 in the present example is a bucket style tappet. The tappet 76 has a surface that is in contact with a lobe 78 on a camshaft 80. As the camshaft 80 and lobe 78 rotate, the surface of the lobe 78 interacts with the tappet 76 to depress the tappet 76 and move the valve stem 72 and head 70 to the closed position with the head 70 seated in the valve seat 62.

The lobe 78 is shaped and sized to provide the desired valve timing, including the desired lift and duration for the valve 42. In other examples, the valve 42 is controlled to have variable valve timing as is known in the art. The valve mechanism may also include various rockers, pushrods, and the like as are known in the art. At least a portion of the valve mechanism is positioned in a region 79 of the cylinder head 52.

The valve 42 also has a valve guide 82. The guide 82 is a cylindrical sleeve that is provided within the cylinder head that maintains the position of the stem and head of the valve 42. The valve stem 72 extends through the guide 82 or through the sleeve. Clearance is provided between the inner wall of the guide 82 and the stem 72 such that the stem easily slides within the guide while preventing gases and lubricant from flowing across the guide. The guide 82 is sized to allow for diametrical wear over the life of the engine while maintaining clearance with and positioning of the stem 72. The guide is commonly made from steel, steel alloy, or another material that is wear resistant.

In an engine with a conventional intake or exhaust valve, the interface between the valve stem and the inner wall of the guide is typically unlubricated. For the conventional valve, as the valve mechanism is lubricated, a seal is positioned over the upper end of the valve guide to prevent lubricant from reaching the intake port, exhaust port or combustion chamber.

For the valves 42, 44 according to the present disclosure, the interface between the valve guide 82 and the valve stem 72 is lubricated and additional sealing members are provided to prevent lubricant from flowing past the valve guide and reaching the intake or exhaust ports. The valves 42, 44 according to the present disclosure are described below in greater detail with reference to FIGS. 2-4.

The engine 20 has a lubrication system 90 to lubricate various moving components of the engine 20, to reduce friction and wear on moving components, and to manage heat loads in the engine. The system 90 may be controlled by a lubrication system controller or the engine controller.

The lubrication system 90 may be integrated into the engine 20 with various cast and/or machined passages in the block and head. These passages are also referred to as galleries, and may include both high pressure and low pressure galleries. The lubrication system 90 may contain various lubricants as the working fluid, with these lubricants generally referred to as "oil". The system 90 has one or more pumps 92, an oil cooler 94 or other heat exchanger, and a filter. The system 90 may also have a reservoir 96 or sump. The lubrication system 90 may provide lubricating fluid to the crankshaft, the camshafts, and other engine components. The lubricant is shown as being pumped from the reservoir 96 into passages within the engine to the components that require lubrication. From the components, the lubricant then drains back through channels provided in the engine to the sump.

In the present example, the pump 92 provides pressurized lubricant to the valves 42, 44 to lubricant the valve mechanisms and the bearings associated with the camshafts. The lubricant then drains from the region in the head surrounding the valves 42, 44 to the sump 96. The pump 92 also provides pressurized lubricant to passage 98 in the head that is in fluid communication with the valve guide to lubricate the interface between the inner wall of the guide and the moving valve stem.

Figure 2:
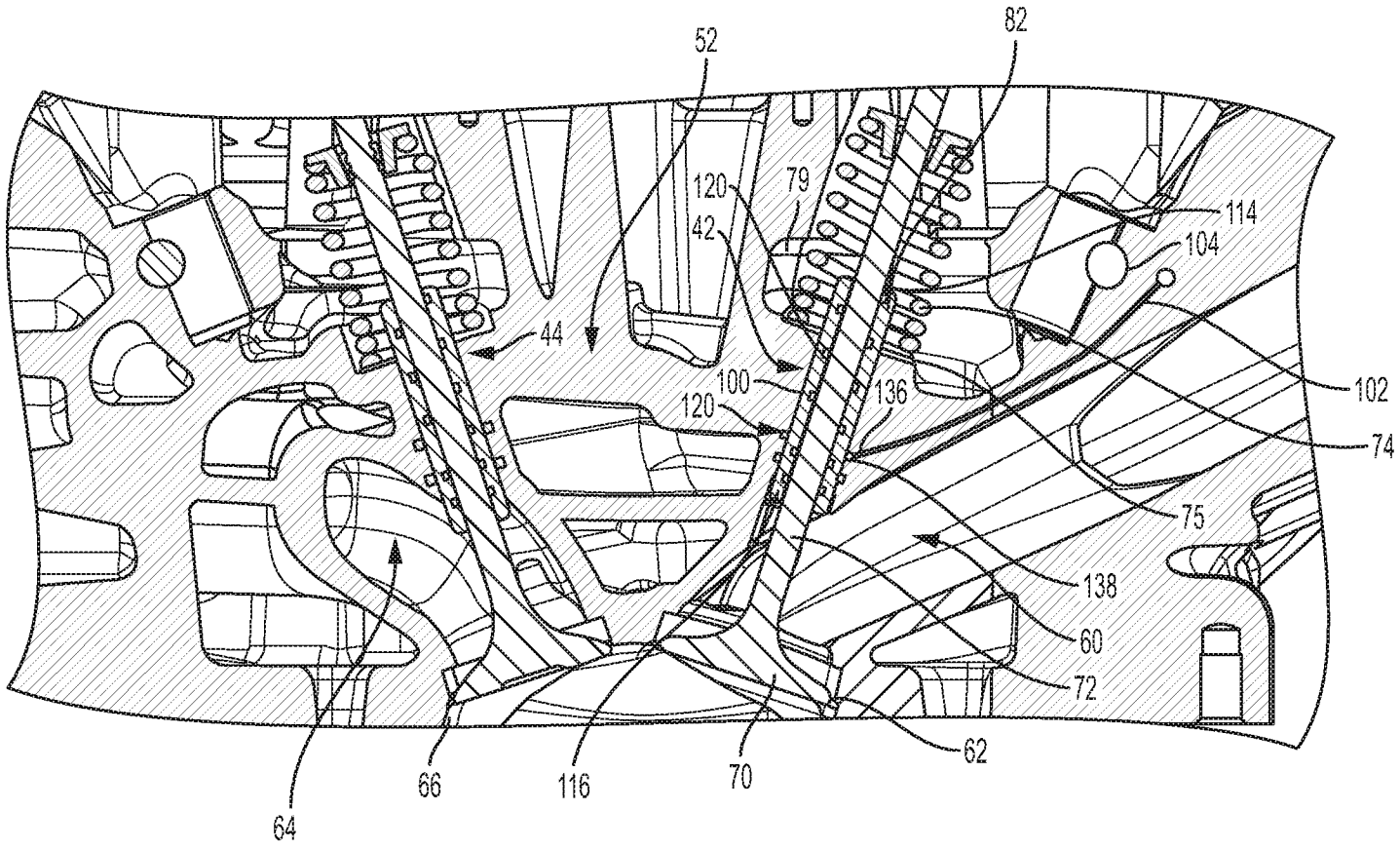
FIG. 2 illustrates a sectional view of a cylinder head for the engine of FIG. 1 according to an embodiment.
Figure 3:
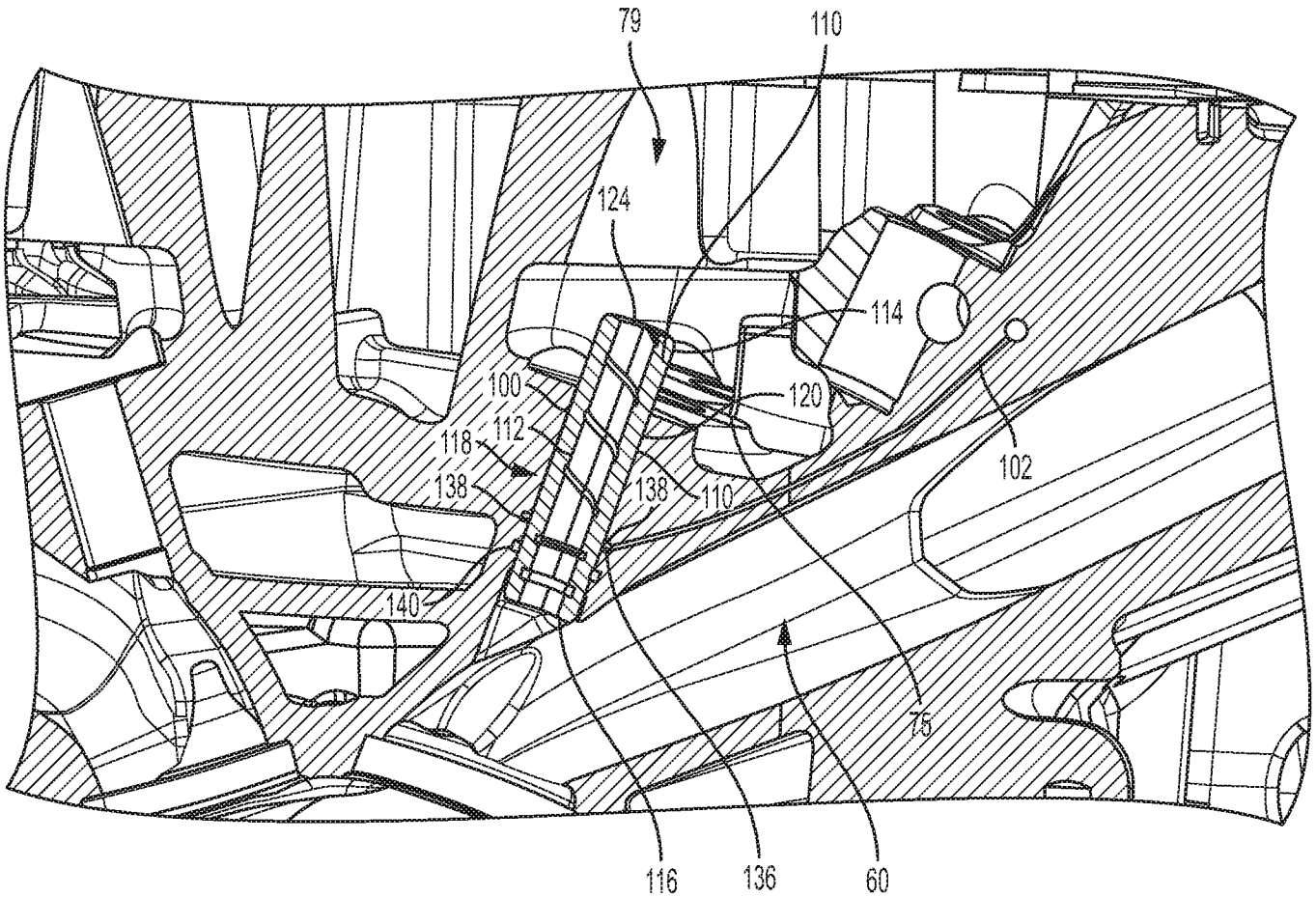
FIG. 3 illustrates another sectional view of the cylinder head of FIG. 2.
Figure 4:
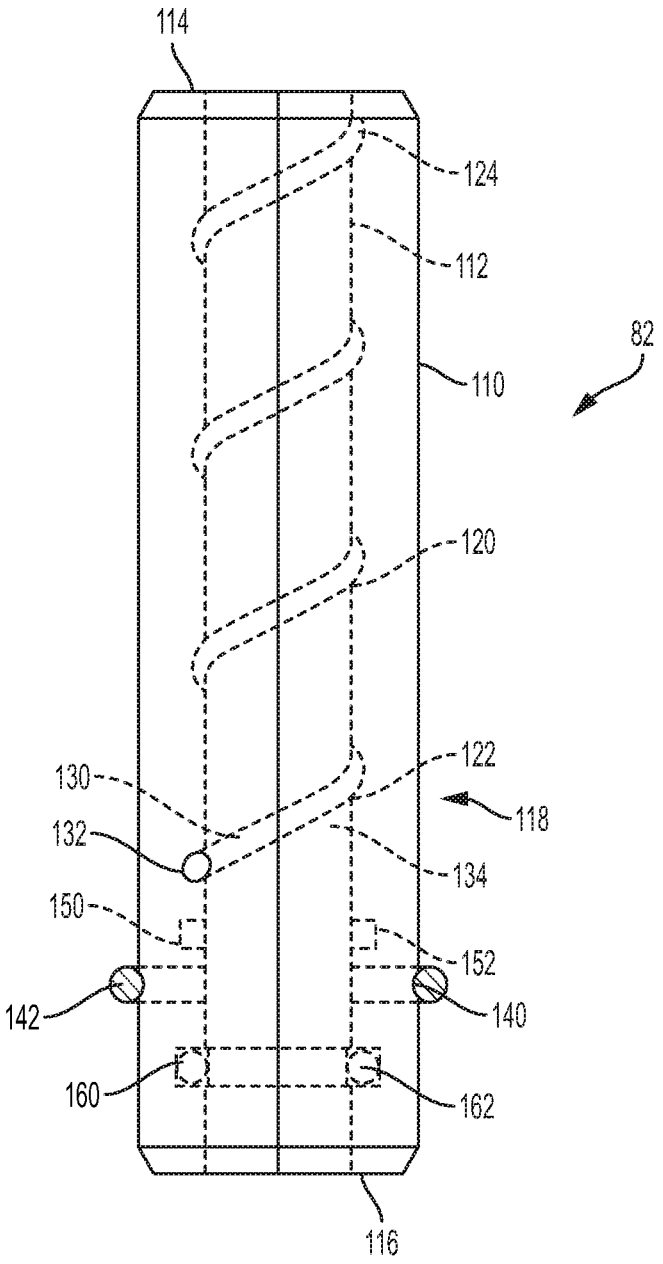
FIG. 4 illustrates a side perspective of a valve guide for the cylinder head of FIG. 2.

With reference to FIGS. 2-4, a valve for a cylinder head is illustrated. The valve is described below as being an intake valve 42, however, the valve may alternatively be used an exhaust valve 44 in various embodiments. Elements similar to or the same as those described above with respect to FIG. 1 are given the same reference number.

FIG. 2 illustrates a sectional view of a cylinder head 52 for an engine 20 with a valve 42 according to an embodiment. FIG. 3 illustrates the sectional view of FIG. 2 with the valve stem removed. FIG. 4 illustrates the valve guide 82 as shown in FIGS. 2-3.

The cylinder head 52 defines an valve guide bore 100 that extends towards the intake port 60 in the case of an intake valve 42 as shown, or towards an exhaust port 64 for an exhaust valve 44. The guide bore 100 may be provided as a cylindrical bore within the head 52, and may be machined or otherwise formed in the head. For a cylindrical bore 100, the bore wall is a continuous wall. In the example shown, the bore 100 has a constant diameter along the length of the bore.

The cylinder head 52 defines a lubrication gallery 102 intersecting the valve guide bore 100 wall. The lubrication gallery 102 is provided as an internal passage in the head 52, and receives lubricant from the lubricant circuit 90 for the engine. The lubrication gallery 102 is in fluid communication with another oil gallery such as the main oil gallery 104 in the head, and may be directly fluidly coupled thereto. The pump 92 in the lubrication circuit 90 provides pressurized lubricant to the main oil gallery 104 in the head, and the pressurized lubricant then flows to the lubrication gallery 102. The pressurized lubricant in the lubrication gallery 102 may be at a lower pressure and flow rate than the lubrication in the main gallery 104. In one example, the lubrication gallery 102 has a reduced diameter passage to restrict and limit the flow of lubricant therethrough. For example, the lubrication gallery 102 may have a diameter on the order of approximately a millimeter or less. In one example, the lubrication gallery 102 may be provided in a cylinder head 52 formed by an additive manufacturing technique.

The valve guide 82 is positioned within the bore 100. The guide 82 may be provided by an annular cylindrical member, or a sleeve shaped member. The guide 82 has an outer wall 110 in contact with and supported by the cylinder head, and an inner wall 112 that surrounds the valve stem 72. The inner and outer walls 112, 110 extend between the valve-side end (or valve tip end) 114 of the guide and the port-side end (or port end) 116 of the guide 82. The valve end 114 of the guide is the end of the guide that is positioned adjacent to the valve mechanism and is surrounding by the valve spring pack 74. The port end 116 of the guide is opposite to the valve end 114 and is positioned adjacent to the intake or exhaust port 60, 64 for an intake valve or exhaust valve, respectively. The port end 116 of the guide may be positioned to be flush or generally flush with a roof of the intake or exhaust port. An intermediate region 118 of the guide 82 is positioned between and spaced apart from the ends 114, 116.

The outer wall 110 may be provided by a generally cylindrical surface that is received by a cylindrical bore 100 in the head. The inner wall 112 may be provided by a generally cylindrical surface that receives the stem 72 of the valve. The inner wall 112 may be positioned to be concentric with the outer wall 110 about the longitudinal axis of the valve stem 72. The valve stem 72 extends through the valve guide 82 such that the head 70 of the valve is positioned in the port 60 for engagement with the valve seat 62.

The inner wall 112 of the guide defines a channel 120 extending from a first end 122 at an intermediate region 118 of the guide to a second end 124 at the valve end 114 of the guide. The intermediate region 118 of the valve guide is positioned between the valve and port ends 114, 116, and is spaced apart from the valve and port ends 114, 116. The channel 120 may be formed as a continuous open channel or groove with a first end 122 at the intermediate region of the guide, and a second end 124 at the valve end of the guide. The second end 124 of the channel may intersect the valve-side end face 114 of the guide 82 as shown.

The channel 120 is provided by the guide 82 as an open channel intersecting the inner wall 112 of the valve guide to provide lubricant to the interface between the inner wall 112 of the guide and the moving valve stem 72. The channel 120 may follow a continuous curved path along the inner wall 112 of the guide. In the example shown, the channel 120 follows a helical path along the inner wall 112 of the guide. The helical path may have a constant pitch or a varying pitch. The channel 120 may have a uniform depth along the length of the channel, or may have a varying depth. The cross-sectional shape of the channel 120 may be u-shaped, v-shaped, or another shape. The channel 120 is shown as wrapping circumferentially around the inner wall 112 a number of times, and in alternative embodiment, the channel may wrap circumferentially around the inner wall 112 only once or less. In alternative embodiment, the channel 120 may follow other shaped paths.

The valve guide 82 also defines a passage 130 extending outwardly in the intermediate region 118. The passage 130 extends generally radially outwardly through the valve guide 82 from the inner wall 112 to the outer wall 110. The passage 130 fluidly connects the gallery 102 and the channel 120. The passage 130 and the channel 120 cooperate to form a fluid flow path for the guide 82.

The passage 130 extends from the first end 122 of the channel to the outer wall 110 of the guide. The passage 130 is in fluid communication with the lubrication gallery 102 such that the passage 130 receives lubricant from the gallery 102 and directs it to the channel 120. The passage 130 has an entrance 132 intersecting the outer wall 110 of the guide and an outlet 134 intersecting the first end 122 of the channel 120 in the intermediate region 118 of the guide. In a further example, the passage 130 is formed as an enclosed, internal extension passage of the channel 120 such that a smooth and continuous flow path is provided for the lubricant. The passage 130 may be an extension of the continuous curved path or helical path of the channel 120.

In one example, the entrance 132 to the passage overlaps with the gallery 102 at the bore wall 100 such that the passage 130 is aligned with the outlet 136 of the gallery. In another example, as shown, the valve guide bore wall 100 of the head further defines a circumferential groove 138 intersecting the lubrication gallery 102. The passage 130 of the guide at the outer wall 110 overlaps with the circumferential groove 138 of the valve guide bore wall 100.

In another example, the lubrication gallery 102 does not include a circumferential groove 138, and instead the outer wall 110 of the valve guide defines a circumferential groove (not shown) at the intermediate region similar in function to groove 138, with the guide-side groove intersecting the passage 130 and overlapping with the lubrication gallery outlet 136 at the bore wall 100.

The outer wall 110 of the guide at the bore wall 100 defines a first circumferential groove 140 positioned between the intermediate region 118 and the port-side end 116 of the guide. As shown in the Figures, the groove 140 is positioned between the circumferential lubrication groove 138 and the port end 116 of the guide and associated port 60 in the head. A first sealing member 142 is positioned in the first groove 140 and is in contact with the guide bore wall 100 to seal the interface between the outer wall 110 of the guide and the bore wall 100 of the cylinder head, and provide a valve guide 82 to air-path seal. The first sealing member 142 may be provided by an O-ring. The first sealing member 142 may be formed from a fluorocarbon based material or another material with appropriate high temperature resistance with chemical resistance.

The inner wall 112 of the guide defines a second circumferential groove 150 positioned between the intermediate region 118 and the port-side 116 end of the guide. As shown in the Figures, the groove 150 is positioned between the port end 116 of the guide and the outlet 134 of the guide passage 130 and first end 122 of the channel 120. A second sealing member 152 is positioned in the second groove 150 and is in contact with the valve stem 72 to seal the interface between the inner wall 112 of the guide and the valve stem 72, and provide a valve stem seal. In one example, the second sealing member 152 is provided as the primary valve stem seal. The second sealing member 152 may be provided by an O-ring. The second sealing member 152 may be formed from a fluorocarbon based material or another material with appropriate high temperature resistance with chemical resistance.

The inner wall 112 of the guide may also define a third circumferential groove 160 positioned between the second groove 160 and the port-side end 116 of the guide. A third sealing member 162 is positioned in the third groove 160 and is in contact with the valve stem 72 to seal the interface between the inner wall 112 of the guide and the valve stem 72, and provide a valve stem seal. In one example, the third sealing member 162 is provided as a secondary valve stem seal. The third sealing member 162 may be provided by an O-ring. The third sealing member 162 may be formed from a material with high temperature resistance and chemical resistance that also provides a low friction interface between the seal and the valve stem, and in one example is formed from a fluorocarbon such as polytetrafluoroethylene, and in another example is formed as a glass-filled polytetrafluoroethylene O-ring, and in yet another example is formed as a compressed graphite O-ring sealing member.

As shown in the Figures, the valve-side end 114 of the guide is unsealed such that lubricant may exit the channel 120 at the valve end 114 of the guide, and flow into the head 52 into the space 79 provided for the valve spring pack 74. The lubricant then flows from this region 79 into a channel in the head 52 and engine 20 that drains the lubricant back the sump 96 of the lubricant circuit 90. A conventional valve guide is provided with a sealing member that extends around the valve stem and covers the valve end of the guide to be in contact with or immediately surrounding the valve spring seat. This conventional sealing member over the valve end of the guide is not provided for use with the valve 42 and head 52 of the present disclosure, and as such, sealing members 142, 152, 162 are provided according to the present disclosure as described above.

The intermediate region 118 of the guide may be defined as being spaced apart from the valve and port ends 114, 116 of the guide, with the intermediate region 118 being positioned near to or adjacent to the port end 116 while providing sufficient space for the grooves and sealing members 142, 152, 162. By positioning the intermediate region 118 towards the port end 116, a longer section of the interface between the inner wall 112 of the guide and the valve stem 72 is directly lubricated by the channel 120.

In further examples, the inner wall 112 of the valve guide 82 defines another channel extending from an intermediate region of the guide to the valve-side end of the guide. The guide defines another passage extending outwardly from the another channel at the intermediate region to the outer wall, with the another passage fluidly connected to the lubrication gallery. In this example, the channel and the another channel may be non-intersecting to provide two flow paths or channels for lubricant along the interface. The another channel and another passage may be provided similarly to channel 120 and passage 130.

Generally, during engine operation, the disclosure provides for a lubricated interface between the valve stem 72 and the inner wall 112 of the valve guide by providing a continuous pressurized flow of lubricant from an intermediate region 118 of the valve guide 82 towards the valve end 114 of the guide, from where it flows into the valve packaging space 79 in the head and eventually back to the sump 96. By providing a pressurized flow of lubricant at a controlled pressure and flow rate to an intermediate region 118 of the valve guide 82, lubrication of the interface may be controlled, opposed to trying to lubricate the interface via a gravity feed of lubricant from the valve packaging space in the head.

The lubrication circuit 90 of the engine uses a pump 92 to provide pressurized lubricant to an lubricant gallery 102 defined in a cylinder head 52, with the lubricant gallery 102 intersecting a valve guide bore wall 100 of the cylinder head. The lubricant is directed from the lubricant gallery 102 into a passage 130 extending through an intermediate region 118 of the valve guide 82 from the outer wall 110 to the inner wall 112.

A moving valve stem 72 is positioned within the valve guide 82 and the interface between the moving stem and the surrounding valve guide is lubricated by flowing lubricant from the passage 130 into an entrance 122 of a channel 120 intersecting the inner wall 112 of the guide, along the channel 120, and to an exit 124 of the channel 120 at a valve end 114 of the guide. The channel 120 may follow a curved path, a helical path, or another path along the inner wall of the guide.

The lubricant exits the channel 120 at the valve end 114 of the guide and flows into the valve packaging space 79 in the head, and to a lubricant drain channel in the engine and to the lubricant sump 96. The guide 82 is therefore provided with one or more sealing members 142 to seal the interface between the outer wall 110 of the guide and the bore wall 100 of the head to prevent lubricant exiting the channel 120 from flowing through this interface from the valve end 114 of the guide and into the port 60. Therefore, the interface between the outer wall 110 of the valve guide and the valve guide bore wall 100 is sealed by positioning a first sealing member 142 between the intermediate region 118 of the valve guide and a port end 116 of the valve guide.

The guide 82 is also provided with one or more sealing members 152, 162 to seal the interface between the inner wall 112 of the guide and the valve stem 72 to prevent lubricant in the channel 120 from flowing into the port 60 through the interface between the inner wall 112 of the guide and the valve stem 72. Therefore, the interface between the inner wall 112 of the valve guide and the valve stem 72 is sealed by positioning a second sealing member 152 between the intermediate region 118 of the valve guide and a port 116 end of the valve guide. A third sealing member 162 may also be positioned between the second sealing member 152 and the port end 116 of the guide to provide a secondary seal for this interface.

The engine 20 and valve guide 82 according to the present disclosure therefore provides lubricity between a moving valve and valve stem 72 of an engine intake or exhaust valve 42, 44 and the adjacent valve guide running surface to reduce heat and friction at this interface and improve overall engine system performance and efficiency, while preventing flow of lubricant into an adjacent port 60, 64.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine comprising:

a cylinder head defining a lubrication gallery, the head defining a valve guide bore wall with a circumferential groove formed therein, the lubrication gallery intersecting the valve guide bore wall, the circumferential groove intersecting the lubrication gallery; and a valve guide received by the valve guide bore wall of the head, the guide and having inner and outer walls intersecting valve-side and port-side ends, the inner wall defining a channel extending from an intermediate region of the guide to the valve-side end, the guide defining a passage extending outwardly from the channel at the intermediate region to the outer wall, the passage fluidly connected to the gallery.

2. The engine of claim 1 wherein the passage of the guide at the outer wall overlaps with the circumferential groove of the valve guide bore wall of the head.

3. The engine of claim 1 wherein the outer wall of the valve guide further defines a circumferential groove at the intermediate region, the circumferential groove intersecting the passage, the circumferential groove of the guide overlapped with the lubrication gallery.

4. The engine of claim 1 further comprising a pump fluidly connected to the lubrication gallery and providing pressurized lubricant thereto.

5. The engine of claim 4 further comprising a lubricant sump, the pump fluidly connected to the sump and receiving lubricant therefrom, wherein a region of the head surrounding a valve spring is fluidly connected to the sump to provide lubricant thereto;

wherein the valve-side end of the valve guide is unsealed to fluidly connect and provide a lubricant flow path from the channel in the valve guide into the region of the head surrounding a valve spring.

6. The engine of claim 1 wherein the channel is further defined as a groove intersecting the inner wall of the valve guide, the groove extending from a first end in the intermediate region of the guide to a second end intersecting the valve-side end of the guide; and wherein the passage of the valve guide extends radially outwardly in the intermediate region of the valve guide, the passage having an entrance intersecting the outer wall of the guide and an outlet intersecting the first end of the groove at the intermediate region.

7. The engine of claim 1 wherein the channel follows a curved path along the inner wall of the guide.

8. The engine of claim 1 wherein the inner wall of the valve guide defines another channel extending from an intermediate region of the guide to the valve-side end, the guide defining another passage extending outwardly from the another channel at the intermediate region to the outer wall, the another passage fluidly connected to the gallery.

9. The engine of claim 8 wherein the channel and the another channel are non-intersecting.

10. The engine of claim 1 wherein one of the bore wall of the head and the outer wall of the guide defines a first circumferential groove positioned between the intermediate region and the port-side end of the guide; and wherein the engine further comprises a first sealing member positioned in the first groove and contacting the bore wall of the head and the outer wall of the guide.

11. The engine of claim 10 wherein the inner wall of the guide defines a second circumferential groove positioned between the intermediate region and the port-side end; and wherein the engine further comprises a second sealing member positioned in the second groove and contacting a valve stem.

12. The engine of claim 11 wherein each of the first and second sealing members comprise an O-ring.

13. The engine of claim 11 wherein the inner wall of the guide defines a third circumferential groove positioned between the second groove and the port-side end; and wherein the engine further comprises a third sealing member positioned in the second groove and contacting the valve stem.

14. An engine valve guide comprising:

an annular cylindrical member having an inner wall and an outer wall intersecting a valve-side end and a port-side end, wherein the inner wall defines a grooved channel extending from a first end intersecting the valve-side end to a second end in an intermediate region of the member, wherein the intermediate region of the member defines a passage extending radially therethrough and intersecting the outer wall and the second end of the grooved channel, and wherein the outer wall defines an outer circumferential groove positioned between the intermediate region and the port-side end.

15. The engine valve guide of claim 14 wherein the channel follows a helical path.

16. The engine valve guide of claim 14 wherein the inner wall of the member defines a first inner circumferential groove positioned between the intermediate region and the port-side end; and wherein the inner wall of the member defines a second inner circumferential groove positioned between the first inner groove and the port-side end.

17. A method comprising:

providing pressurized lubricant to a lubrication gallery defined in a cylinder head, the lubrication gallery intersecting a valve guide bore wall of the cylinder head;

directing lubricant from the lubrication gallery into a passage extending through an intermediate region of a valve guide from an outer wall to an inner wall;

lubricating a moving valve stem positioned within the valve guide by flowing lubricant from the passage into an entrance of a channel intersecting the inner wall and to an exit of the channel at a valve end of the guide, the channel following a curved path along the inner wall of the guide; and sealing an interface between the outer wall of the valve guide and the valve guide bore wall of the head by positioning a first sealing member between the intermediate region of the valve guide and a port end of the valve guide, the first sealing member contacting the bore wall of the head and the outer wall of the guide.

18. The method of claim 17 comprising:

sealing an interface between the inner wall of the valve guide and the valve stem by positioning a second sealing member between the intermediate region of the valve guide and the port end of the valve guide.

19. The method of claim 17 wherein the lubricant is directed from the lubrication gallery into the passage in the valve guide via a circumferential groove formed in the head, the circumferential groove located within the valve guide bore wall of the head and intersecting the lubrication gallery.

* * * * *